US005921158A

United States Patent [19]

Slusar et al.

[11] Patent Number: 5,921,158

[45] Date of Patent: Jul. 13, 1999

[54] SEALED REVERSIBLE RATCHET WRENCH

[75] Inventors: Randall J. Slusar, Greenfield; Jeffrey H. Hoff, Kenosha, both of Wis.

[73] Assignee: Snap-on Tools Company, Kenosha, Wis.

[21] Appl. No.: 08/984,764

[22] Filed: Dec. 4, 1997

[51] Int. Cl.[6] ..... B25B 13/46

[52] U.S. Cl. ..... 81/63; 81/61; 81/62; 81/60; 81/63.1; 81/63.2; 277/562

[58] Field of Search ..... 81/61, 62, 63, 81/63.1, 63.2, 60; 277/431; 426/392; 429/78

[56] References Cited

U.S. PATENT DOCUMENTS

| | | |
|---|---|---|
| 2,188,846 | 1/1940 | Reub . |
| 2,395,681 | 2/1946 | Odlum et al. . |
| 2,957,377 | 10/1960 | Hare . |
| 3,656,824 | 4/1972 | Ullberg . |
| 3,677,102 | 7/1972 | Simonetta . |
| 4,122,921 | 10/1978 | Diggs et al. . |
| 4,257,507 | 3/1981 | Solomon . |
| 4,301,897 | 11/1981 | Cox, Jr. . |
| 4,347,767 | 9/1982 | Gentiluomo . |
| 4,434,863 | 3/1984 | Garrett . |
| 4,480,703 | 11/1984 | Garrett . |
| 4,484,732 | 11/1984 | Gould . |
| 4,491,043 | 1/1985 | Dempsey et al. . |
| 4,497,227 | 2/1985 | Stasiek . |
| 4,934,220 | 6/1990 | Slusar et al. . |
| 5,139,274 | 8/1992 | Oseman ..... 277/58 |
| 5,495,783 | 3/1996 | Slusar et al. . |
| 5,636,557 | 6/1997 | Ma . |

OTHER PUBLICATIONS

Garlock Klozure Oil Seal Catalog, 1979.

*Primary Examiner*—Timothy V. Eley
*Assistant Examiner*—Philip J. Hoffmann
*Attorney, Agent, or Firm*—Emrich & Dithmar

[57] ABSTRACT

A reversible ratchet wrench includes a ratchet body having a round head portion with a cylindrical, internally toothed opening therethrough forming a ratchet gear and defining a cavity. A ratchet mechanism, including a drive body, a pawl assembly and a reversing member, is disposed in the cavity, with the reversing member secured to the drive body for confining the pawl assembly therebetween. The head of the ratchet body has annular shoulder surfaces thereon respectively at opposite ends of and coaxial with the cavity, and respectively facing annular shoulder surfaces on the drive body and reversing member, for cooperation therewith to define first and second annular spaces, in which are respectively disposed annular seal members, each having a pair of radially inwardly extending and axially diverging flexible and resilient lips, respectively engageable with the shoulder surfaces defining the associated space for cooperation therewith to seal the cavity and center the ratchet mechanism on the head.

19 Claims, 2 Drawing Sheets

SEALED REVERSIBLE RATCHET WRENCH

BACKGROUND OF THE INVENTION

1. Field of the Invention

The present invention relates to ratchet mechanisms and, in particular, to ratchet wrenches of the reversible type having a manually-operated reversing member. The invention relates in particular to seals for the ratchet mechanism.

2. Description of the Prior Art

The present invention is an improvement of the reversible ratchet wrench disclosed in U.S. Pat. No. 5,495,783, the disclosure of which is incorporated herein by reference. Accordingly, only so much of the construction of the ratchet wrench will be described in detail herein as is necessary for an understanding of the present invention.

In the wrench of U.S. Pat. No. 5,495,783, a handle with a circular ratchet head has a cylindrical array of internal ratchet teeth defining a cavity, which receives coaxially rotatably therein a drive body. A pawl is carried by the drive body for movement between forward and reverse conditions of engagement with the ratchet teeth, being retained in each of these positions by an over-center spring engageable with a pin on a reversing lever. The reversing lever is disposed coaxially with the drive body and retained thereon by a bushing and a screw for rotation relative to the drive body and the ratchet head to shift the pawl between its forward and reverse conditions. Annular recesses are formed at each end of the head coaxial with the cavity, and respectively face corresponding annular recesses on the drive body and reversing lever, for cooperation therewith to define annular spaces in which are respectively received annular seal members to retain lubricant in the cavity and prevent the entry of dust and dirt therein. The seals are radial seals, with each seal being disposed between and resiliently engaging opposed cylindrical surfaces of the corresponding recesses. It has been found that the radial compressive force on the radial seals necessary to maintain an effective seal creates a significant frictional drag on the rotating parts, necessitating a significant torque to effect both the ratcheting operation and manual operation of the reversing member.

SUMMARY OF THE INVENTION

It is a general object of the present invention to provide an improved sealed ratchet assembly which avoids the disadvantages of prior ratchet assemblies while affording additional structural and operating advantages.

An important feature of the invention is the provision of a sealed ratchet assembly which provides an effective seal while at the same time minimizing frictional drag on the rotating parts.

In connection with the foregoing feature, a further feature of the invention is the provision of a ratchet assembly of the type set forth, which is of relatively simple and economical construction.

Certain ones of these and other features of the invention may be attained by providing a sealed ratchet assembly comprising: a ratchet body with a cylindrical opening therethrough having an axis and defining a cavity, a first annular shoulder surface formed on the ratchet body at an end of the cavity coaxial therewith and extending parallel to a plane disposed substantially perpendicular to the axis, ratchet mechanism mounted in the cavity and including a drive member mounted for rotation relative to the ratchet body about the axis and having a second annular shoulder surface thereon facing the first annular shoulder surface substantially parallel thereto and coaxial therewith and cooperating therewith to define an annular space therebetween, and a seal member disposed in the annular space and having two radially extending and axially spaced flexible and resilient lips respectively engaged with the shoulder surfaces for cooperation therewith to seal the end of the cavity.

Other features of the invention may be attained a sealed reversible ratchet assembly comprising: a ratchet body with a cylindrical opening therethrough having an axis and defining a cavity, first and second annular shoulder surfaces formed on the ratchet body respectively at first and second ends of the cavity coaxial therewith and extending parallel to a plane disposed substantially perpendicular to the axis, ratchet mechanism mounted in the cavity, the ratchet mechanism including a drive member mounted for rotation relative to the ratchet body about the axis and having a third annular shoulder surface thereon facing the first annular shoulder surface substantially parallel thereto and coaxial therewith for cooperation therewith to define a first annular space therebetween, the ratchet mechanism including a reversing member mounted for rotation relative to the ratchet body about the axis and having a fourth annular shoulder surface thereon facing the second annular shoulder surface substantially parallel thereto and coaxial therewith for cooperation therewith to define a second annular space therebetween, a first seal member disposed in the first annular space and having two radially extending and axially spaced flexible and resilient lips respectively engaging the first and third shoulder surfaces for cooperation therewith to seal the first end of the cavity, and a second seal member disposed in the second annular space and having two radially extending and axially spaced flexible and resilient lips respectively engaging the second and fourth shoulder surfaces for cooperation therewith to seal the second end of the cavity.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
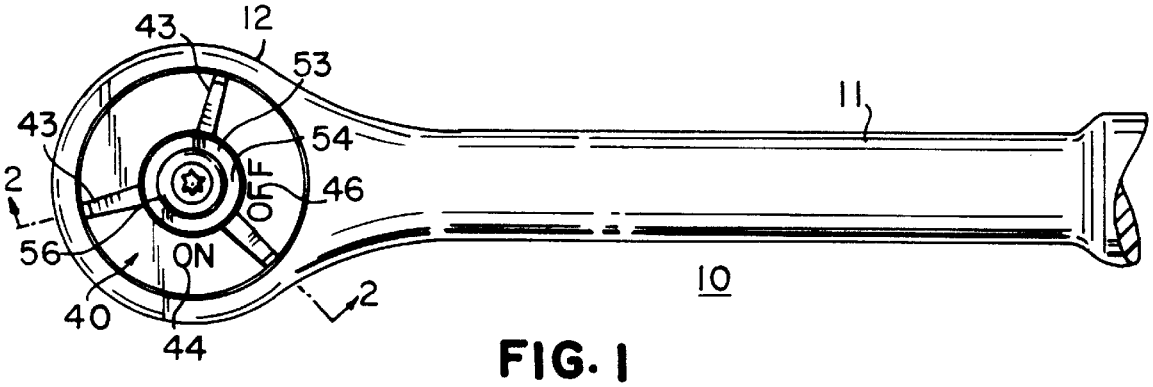
FIG. 1 is a top plan view of a ratchet wrench constructed in accordance with and embodying the features of the present invention.
Figure 2:
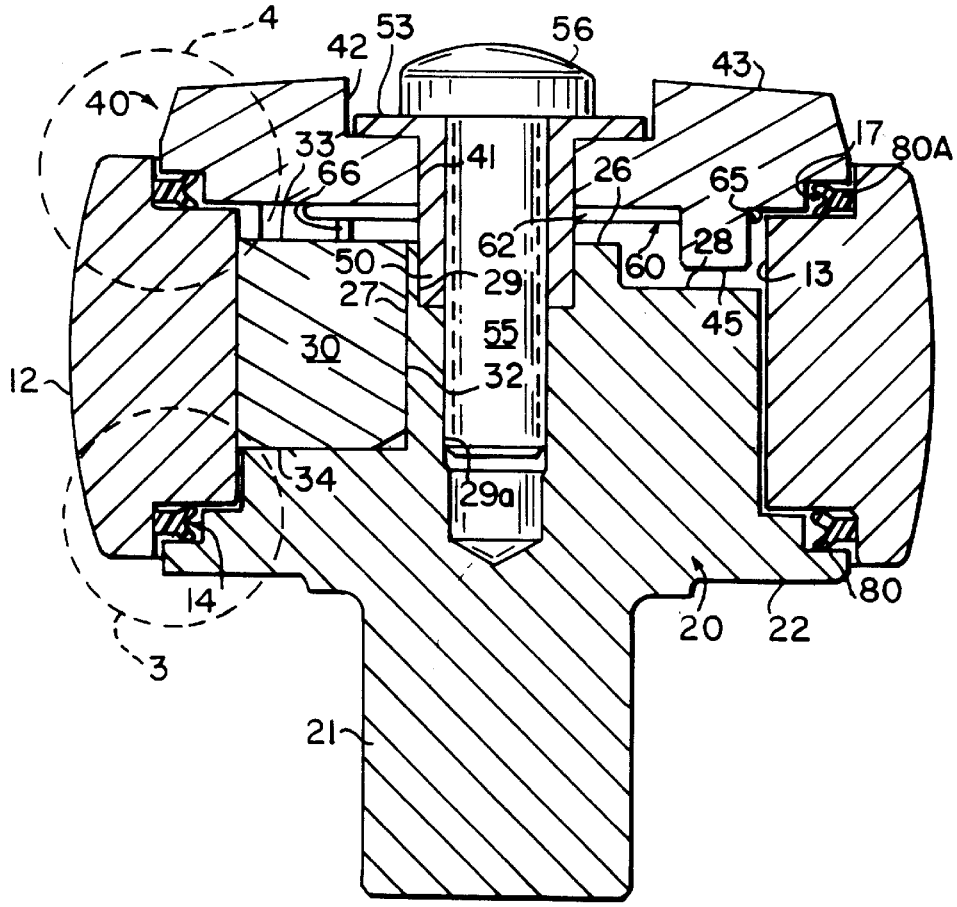
FIG. 2 is an enlarged view in vertical section taken along the line 2—2 in FIG. 1.
Figure 4:
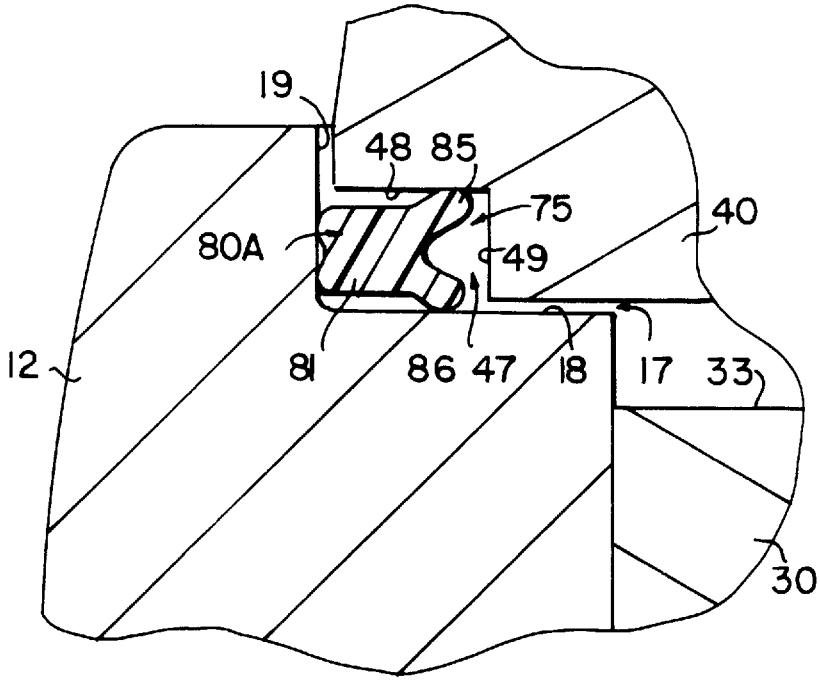
FIG. 4 is a further enlarged, fragmentary, sectional view of the portion designated 4 in FIG. 2.
Figure 3:
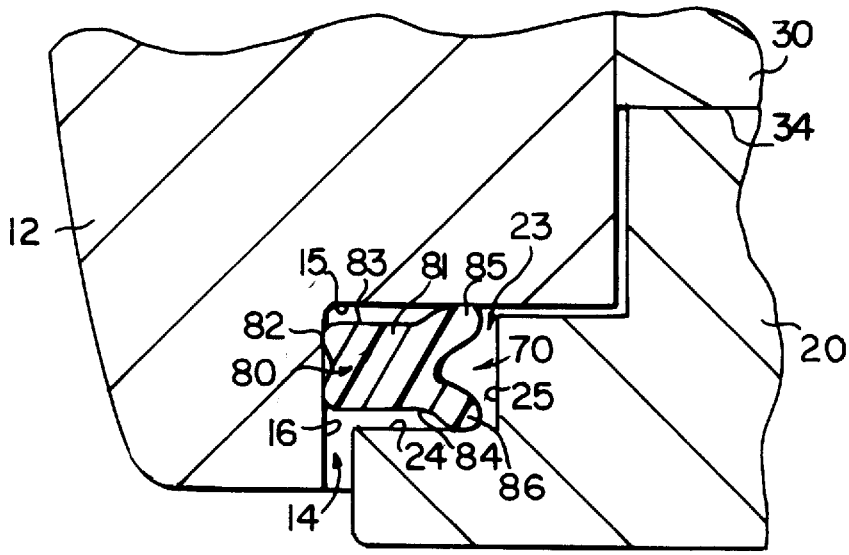
FIG. 3 is a further enlarged, fragmentary, sectional view of the portion designated 3 in FIG. 2.

Referring to FIGS. 1 and 2, there is illustrated a reversible ratchet wrench, generally designated by the numeral 10, constructed in accordance with and embodying the features of the present invention. The ratchet wrench 10 hats an elongated handle 11 having formed unitary therewith at one end thereof a circular ratchet head 12, which has an enlarged circular bore or opening 13 formed axially therethrough and defining a cavity therein. Formed on the inner surface of the bore 13 is a cylindrical array of equiangularly spaced-apart ratchet teeth (not shown). The bore 13 extends between opposite side surfaces of the head 12. Referring also to FIGS. 3 and 4, the opposite side surfaces of the head 12, respectively have formed therein annular recesses or counterbores 14 and 17, the recess 14 having a substantially flat, planar annular end surface 15 and a cylindrical side surface 16, both substantially coaxial with the bore 13. Similarly, the recess 17 has a planar, annular end surface 18 and a cylindrical side surface 19, both of which are substantially coaxial with the bore 13.

Disposed coaxially in the bore 13 for rotation about the axis thereof relative to the head 12 is a drive body 20, having a square drive lug 21 unitary therewith at one end thereof and projecting axially therefrom for engagement with an associated driven member, such as a socket, all in a known manner. The drive lug 21 may be provided with a depressible detent ball (not shown), also in a known manner. Referring also to FIG. 3, the drive body 20 is provided with a radially outwardly extending annular flange 22 dimensioned to be received in the annular recess 14 of the ratchet head 12. The flange 22, in turn, has an annular recess 23 formed therein, including a substantially planar annular end surface 24 and a cylindrical side surface 25, both arranged to be substantially coaxial with the bore 13 in the assembled condition of the parts.

The drive body 20 has an end surface 26 formed at the other axial end thereof opposite the drive lug 21, the drive body 20 being dimensioned so that the end surface 26 is disposed axially inwardly of the annular recess 17 when the annular flange 22 is seated in the annular recess 14, as illustrated in FIG. 2. The end surface 26 has a deep pawl recess 27 formed therein at one side thereof. Formed in the end surface 26 at the opposite side thereof is a shallower pin recess 28. Also formed in the end surface 26 intermediate the pawl recess 27 and the pin recess 28, substantially axially of the drive body 20, is a substantially rectangular recess 29. Formed centrally of the rectangular recess 27 and coaxially with the drive body 20 is an internally threaded cylindrical bore 29*a*.

Seated in the pawl recess 27 is a pawl 30. Formed on the outer side of the pawl 30 is an arcuate array of teeth (not shown) facing and dimensioned for meshing engagement with the ratchet teeth of the head 12. Formed on the opposite side of the pawl 30 is a flat rear surface 32 dimensioned for sliding engagement with the axial wall of the pawl recess 27. The pawl tooth array and the rear surface 32 thereof extend between flat, parallel, top and bottom surfaces 33 and 34 of the pawl 30.

Referring also to FIG. 4, the ratchet wrench 10 is also provided with a reversing lever 40, generally in the shape of a circular disk having an axial bore 41 formed therethrough and surrounded at the upper end thereof with an annular recess 42. Formed on the outer surface of the reversing lever 40 are three equiangularly spaced-apart and radially extending ribs 43. Depending from the inner surface of the reversing lever 40 and spaced a predetermined distance radially outwardly from the bore 41 is a cylindrical pin 45, which is preferably unitary with the lever 40. Formed on the outer surface of the reversing lever 40, radially just outside the recess 42 and at angularly spaced-apart locations, are ON and OFF indica 44 and 46. The reversing lever 40 is dimensioned to be seated in the recess 17 of the head 12, the reversing lever 40 having an annular recess 47 in the inner surface thereof at the outer edge thereof, defining a planar, annular end surface 48 and a cylindrical side surface 49, both substantially coaxial with the bore 41. The reversing lever 40 is positioned on the head 12 so that the pin 45 is received in the pin recess 28, the bore 41 being coaxial with the drive body 20.

The ratchet wrench 10 also includes a cylindrical bushing 50 dimensioned to be received through the bore 41 of the reversing lever 40 and into the rectangular recess 29 of the drive body 20. In this regard, the bushing 50 has flats (not shown) formed on diametrically opposite sides thereof adjacent to the distal end thereof. Thus, it will be appreciated that the distal end of the bushing 50 is keyed or non-rotatably received in the rectangular recess 29. The bushing 50 is provided adjacent to its outer end with a radially outwardly extending annular flange 53 which is seated in the recess 42 of the reversing lever 40 when the distal end of the bushing 50 is keyed into the rectangular recess 29. The flange 53 has formed on the outer surface thereof an indicator 54 (FIG. 1). A screw 55 is receivable through the bushing 50 for threaded engagement in the threaded bore 29*a*, the screw 55 having an enlarged head 56 which seats against the annular flange 53. Thus, it will be appreciated that the screw 55 cooperates with the bushing 50 to hold the parts of the ratchet wrench 10 in an assembled condition, retaining the drive body 20 in the annular recess 14, and retaining the reversing lever 40 in the annular recess 17 of the ratchet head 12.

The ratchet wrench 10 also includes a bias spring 60 in the form of an elongated wire spring member having a generally heart-shaped configuration, including a pair of opposed lobes 62 (one shown) and an apex 65, all lying in a plane substantially perpendicular to the axis of the drive body 20 between the reversing lever 40 and the drive body 20. Unitary with the lobes 62, at the ends thereof opposite the apex 65 are anchor ends 66 (one shown in FIG. 2) which extend into a bore (not shown) of the pawl 30. The arrangement and operation of the parts of the ratchet wrench 10 described above are more fully described in the aforementioned U.S. Pat. No. 5,495,783.

Referring in particular to FIGS. 3 and 4 of the drawings, it is a significant aspect of the invention that, when, the parts are assembled, the annular recesses 14 and 17 on the ratchet head 12 cooperate, respectively, with the annular recess 23 of the drive body 20 and the annular recess 47 of the reversing lever 40, to define annular spaces 70 and 75, respectively accommodating annular seals 80 and 80A, which are of substantially identical construction, wherefore only one will be described in detail. Each of the seals 80, 80A is formed of a suitable flexible and resilient material, and has a body 81 which is generally rectangular in transverse cross section, having a generally cylindrical outer end wall 82 and annular top and bottom walls 83 and 84. Unitary with the body 81 and extending radially inwardly therefrom are two axially diverging lips 85 and 86 which extend, respectively, above and below the top and bottom walls 83 and 84.

In use, the seal 80 is disposed in the annular space 70, with the lips 85 and 86 thereof respectively engaging the annular end surface 15 of the ratchet head 12 and the annular end surface 24 on the drive body 20. Similarly, the seal 80A is disposed in the annular spaced 75, with the lips 85 and 86 thereof respectively engaging the annular end surface 48 of the reversing lever 40 and the annular end surface 18 of the ratchet head 12. Thus, when the parts are secured together with the screw 55, the lips 85 and 86 of the seals 80 and 80A are compressed slightly in an axial direction. Accordingly, the seals 80 and 80A are axial seals, exerting sealing forces in axial directions for sealing lubricant in the cavity formed by the bore 13 and for preventing the entry of dust or dirt thereinto.

It has been found that this axial seal arrangement exerts substantially less rotational drag on the assembled parts than prior art radial seals. It is believed that this results, at least in part, from the fact that the double lip seal arrangement minimizes the surface contact between the seals 80 and 80A on the one hand, and the associated annular surfaces defining the annular spaces 70 and 75 on the other hand. It will be appreciated that, because of this axial compressive force, the seals 80 and 80A serve as bias members which cooperate to resiliently center the ratchet head 12 relative to the drive body 20 and the reversing lever 40, to prevent excessive drag or wear on any one side of the ratchet head 12.

In a preferred embodiment of the invention, the seals 80 and 80A are formed of a material which is easily molded and which retains its compliance over a wide range of temperatures, even when in contact with petroleum-based lubricants. Such a material may be a nitrile polymer, although it will be appreciated that other suitable materials could be used.

From the foregoing, it can be seen that there has been provided an improved reversible ratchet wrench and seals therefor which provide effective sealing while minimizing frictional drag and, at the same time, functioning as compression springs to axially center the parts.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A sealed ratchet assembly comprising:

a ratchet body with a cylindrical opening therethrough having an axis and defining a cavity, a first annular shoulder surface formed on said ratchet body at an end of the cavity coaxial therewith and extending parallel to a plane disposed substantially perpendicular to the axis, ratchet mechanism mounted in the cavity and including a drive member mounted for rotation relative to said ratchet body about said axis and having a second annular shoulder surface thereon facing and axially spaced from said first annular shoulder surface substantially parallel thereto and coaxial therewith and cooperating therewith to define an annular space therebetween, and a seal member disposed in said annular space and having a radially inner side and a radially outer side and two axially spaced flexible and resilient lips, said lips extending radially from one of said sides and respectively engaged with said shoulder surfaces for cooperation therewith to seal the end of the cavity.

2. The ratchet assembly of claim 1, wherein said seal member includes an annular seal body having said sides and from which said lips extend.

3. The ratchet assembly of claim 2, wherein said lips diverge from said seal body.

4. The ratchet assembly of claim 2, wherein said ratchet body and said drive member respectively have cylindrical surfaces bounding said annular space, said seal body being disposed in sealing engagement with one of said cylindrical surfaces.

5. The ratchet assembly of claim 2, wherein said lips extend radially inwardly from said seal body.

6. The ratchet assembly of claim 5, wherein said lips diverge axially of said ratchet body.

7. The ratchet assembly of claim 1, wherein said lips diverge axially of said ratchet body.

8. The ratchet assembly of claim 1, and further comprising mounting mechanism connecting said ratchet mechanism to said ratchet body.

9. The ratchet assembly of claim 8, wherein said lips of said seal member resiliently urge said drive member and said ratchet body apart.

10. A sealed reversible ratchet assembly comprising:

a ratchet body with a cylindrical opening therethrough having an axis and defining a cavity, first and second annular shoulder surfaces formed on said ratchet body respectively at first and second ends of the cavity coaxial therewith and extending parallel to a plane disposed substantially perpendicular to the axis, ratchet mechanism mounted in the cavity, said ratchet mechanism including a drive member mounted for rotation relative to said ratchet body about said axis and having a third annular shoulder surface thereon facing and axially spaced from said first annular shoulder surface substantially parallel thereto and coaxial therewith for cooperation therewith to define a first annular space therebetween, said ratchet mechanism including a reversing member mounted for rotation relative to said ratchet body about said axis and having a fourth annular shoulder surface thereon facing and axially spaced from said second annular shoulder surface substantially parallel thereto and coaxial therewith for cooperation therewith to define a second annular space therebetween, a first seal member disposed in said first annular space and having a first radially inner side and a first radially outer side and two axially spaced flexible and resilient first lips, said first lips extending radially from one of said first sides and respectively engaging said first and third shoulder surfaces for cooperation therewith to seal the first end of the cavity, and a second seal member disposed in said second annular space and having a second radially inner side and a second radially outer side and two axially spaced flexible and resilient second lips, said second lips extending radially from one of said second sides and respectively engaging said second and fourth shoulder surfaces for cooperation therewith to seal the second end of the cavity.

11. The ratchet assembly of claim 10, wherein said ratchet body has a cylindrical array of ratchet teeth thereon defining said opening, said ratchet mechanism including a pawl mechanism mounted for ratcheting engagement with said ratchet teeth.

12. The ratchet assembly of claim 10, and further comprising coupling structure interconnecting said drive member and said reversing member for retaining them on said ratchet body respectively at the first and second ends of the cavity.

13. The ratchet assembly of claim 12, wherein said first and second seal members respectively resiliently urge said drive member and said reversing member axially away from said ratchet body for centering said ratchet mechanism relative to said ratchet body.

14. The ratchet assembly of claim 10, wherein said first seal member includes a first annular seal body from which the first lips extend, and said second seal member includes a second annular seal body from which the second lips extend.

15. The ratchet assembly of claim 14, wherein on each of said first and second seal members the lips thereof diverge from the seal body thereof.

16. The ratchet assembly of claim 14, wherein said ratchet body and said drive member respectively have first and second cylindrical surfaces bounding said first annular space and third and fourth cylindrical surfaces bounding said second annular space, said first seal body being disposed in sealing engagement with one of said first and second cylindrical surfaces and said second seal body being disposed in sealing engagement with one of said third and fourth cylindrical surfaces.

17. The ratchet assembly of claim 14, wherein on each of said first and second seal members the lips thereof extend radially inwardly from the seal body thereof.

18. The ratchet assembly of claim 17, wherein on each seal member said lips diverge axially of said ratchet body.

19. The ratchet assembly of claim 10, wherein on each seal member said lips diverge axially of said ratchet body.

* * * * *